US010526813B2

(12) United States Patent
Bliding et al.

(10) Patent No.: US 10,526,813 B2
(45) Date of Patent: Jan. 7, 2020

(54) ELECTRONIC LOCK DEVICE

(71) Applicant: Phoniro AB, Halmstad (SE)

(72) Inventors: Olle Bliding, Halmstad (SE); Johan Horberg, Halmstad (SE); Goran Claesson, Malmo (SE)

(73) Assignee: PHONIRO AB, Halmstad (SE)

( * ) Notice: Subject to any disclaimer, the term of this patent is extended or adjusted under 35 U.S.C. 154(b) by 0 days.

(21) Appl. No.: 15/580,458

(22) PCT Filed: Jun. 23, 2016

(86) PCT No.: PCT/SE2016/050627
§ 371 (c)(1),
(2) Date: Dec. 7, 2017

(87) PCT Pub. No.: WO2017/018920
PCT Pub. Date: Feb. 2, 2017

(65) Prior Publication Data

US 2018/0163431 A1 Jun. 14, 2018

(30) Foreign Application Priority Data

Jul. 1, 2015 (SE) ..... 1550929

(51) Int. Cl.
*E05B 47/00* (2006.01)
*E05B 47/02* (2006.01)
*G07C 9/00* (2006.01)

(52) U.S. Cl.
CPC ..... *E05B 47/0012* (2013.01); *E05B 47/026* (2013.01); *G07C 9/00* (2013.01);
(Continued)

(58) Field of Classification Search
CPC .... E05B 47/0012; E05B 47/02; E05B 47/026; E05B 2047/0014; E05B 2047/0015;
(Continued)

(56) References Cited

U.S. PATENT DOCUMENTS 4,819,493 A 4/1989 Dornan
5,857,365 A * 1/1999 Armstrong ..... E05B 47/0012 292/142

(Continued)

FOREIGN PATENT DOCUMENTS

SE 532854 C2 4/2010
WO WO-2008/101930 A1 8/2008

OTHER PUBLICATIONS

International Search Report PCT/ISA/210 and Written Opinion of the International Searching Authority PCT/ISA/237 for International Application No. PCT/SE2016/050627 dated Sep. 5, 2016.

(Continued)

*Primary Examiner* — Christopher J Boswell
(74) *Attorney, Agent, or Firm* — Harness, Dickey & Pierce, P.L.C.

(57) ABSTRACT

An electronic lock device configured to be externally mounted on a building door is provided, and being configured to operate a lock by moving a lock bolt of an associated lock case between a retracted position and a protruded position. The device includes an electrical motor and a transmission for connecting said electrical motor to the associated lock case. The transmission includes a rotatable shaft configured to be connected to a lock follower of the lock case, and a rotatable member being drivingly connected to the electrical motor and being connected to an engagement member being allowed to pivot upon rotation of the rotatable member, such that the engagement member is engaging with the rotatable shaft when the electrical motor is driving the rotatable member.

17 Claims, 8 Drawing Sheets

(52) U.S. Cl.
CPC . *E05B 2047/002* (2013.01); *E05B 2047/0017* (2013.01); *E05B 2047/0026* (2013.01); *E05B 2047/0083* (2013.01); *E05B 2047/0091* (2013.01); *E05B 2047/0094* (2013.01); *E05B 2047/0095* (2013.01); *G07C 9/00309* (2013.01)

(58) Field of Classification Search
CPC ..... E05B 2047/0017; E05B 2047/0018; E05B 2047/002; E05B 2047/0083; E05B 2047/0091; E05B 2047/0094; E05B 2047/0095
See application file for complete search history.

(56) References Cited

U.S. PATENT DOCUMENTS 6,012,310 A * 1/2000 Hsiao ..... E05B 47/0012 292/144
6,517,127 B1 2/2003 Lu et al.
8,365,561 B2 * 2/2013 Chang ..... E05B 47/02 292/142
8,490,445 B2 * 7/2013 Chiou ..... E05B 47/0012 70/224
8,621,900 B2 * 1/2014 Wu ..... E05B 47/026 292/142
8,925,982 B2 1/2015 Bliding et al.
9,097,037 B2 * 8/2015 McKibben ..... E05B 47/0001
2003/0209043 A1 * 11/2003 Yeh ..... E05B 47/0012 70/280
2009/0173120 A1 * 7/2009 Lin ..... E05B 17/0058 70/279.1
2009/0205384 A1 8/2009 Pomerantz
2010/0089109 A1 4/2010 Bliding et al.
2015/0308157 A1 * 10/2015 Lin ..... E05B 63/04 292/144

OTHER PUBLICATIONS

Office Action for Swedish Patent Application No. 1550929-2 dated Jan. 21, 2016.

* cited by examiner

ELECTRONIC LOCK DEVICE

CROSS-REFERENCE TO RELATED APPLICATIONS

This application is the U.S. National Phase application of PCT Application No. PCT/SE2016/050627 filed on Jun. 23, 2016, which claims priority to Swedish Application No. 1550929-2 filed on Jul. 1, 2015, the contents of each of which are incorporated herein by reference.

TECHNICAL FIELD

The present invention relates to an electronic lock device. More particularly, the present invention relates to an electronic lock device to fit with an existing lock case of an architectural door, i.e. building doors, which electronic lock device may form part of a door lock such that the door lock may be operated either electrically or manually.

BACKGROUND

For architectural doors, i.e. building doors, electronic door locks are widely used in various types of applications, such as elderly care and nursing homes, hotels, public facilities, etc. One specific type of electronic door locks utilizes mechanical and non-electrical lock cases which are inserted in a door leaf in a conventional manner, i.e. into a recess provided at one edge of the door leaf. The electronic door lock is formed by the lock case as well as an additional electronic lock device which is connected to the lock case e.g. by mounting the lock device on the inner or outer side of the door leaf.

One example of such lock device is described in WO2008101930 by the same applicant. The lock device has an electric motor which is in connection with the lock bolt via a transmission. When the electrical motor is activated the rotational movement is transmitted to the lock case whereby the lock bolt is maneuvered for locking or unlocking the door. Should a user decide to operate the door lock manually, which may be the case if he or she would like to lock the door from the inside, the lock knob may be turned.

In order to have the same mechanical feeling independent of the motor/gear design when turning the key or knob, it is suggested to include a disengagement system. The disengagement is provided by means of a hub having a lug engaging with the axle around which the lock knob rotates. When the lock knob is turned so is the hub.

Once the electrical motor has been activated for unlocking the door, it is important to ensure that the electrical motor is returning to a non-engaging position.

Further, the electronic lock device should preferably be compatible with several different existing lock cases.

Existing lock cases may have different operational schemes; for example, one existing lock case has a lock bolt which is unelastically connected to the lock follower, i.e. to the shaft rotating upon maneuvering the lock knob. For such lock case, when the lock bolt is positioned in an end position (i.e. a locked state or an unlocked state) it is not possible to operate the lock knob further towards that end position, but only towards the opposite end position.

Another existing lock case operates according to a slightly different principle. Rotation of the lock knob (or cylinder key) will cause a retraction of the lock bolt for unlocking the door, however the lock follower is also connected to a spring biased latch, always urging towards it protruded position.

For unlocking the door the lock follower is thus rotated for causing an unlocking movement of the lock bolt as well as of the latch.

A yet further lock case existing on the market relies on a different operation principle. The lock follower is maneuvered for unlocking the door causing an unelastic connection with the lock bolt. Once the lock bolt is in its end position unlocking the door, the lock follower may be further rotated in the unlocking direction for causing a subsequent opening movement of a spring-biased latch.

In view of all these examples, it is evident that disengaging or engaging of the motor will depend on the actual end position of the hub relative the ring. For improving the electronic lock device it would thus not only be desirable to reduce the time or distance for engaging the electrical motor, but also to allow the solution to be used for many different existing lock cases. Hence, a versatile electronic lock device would be advantageous which provide efficient and reliable disengaging/engaging of the motor independent of the operation principle of the lock case.

SUMMARY

In view of the above, an objective of the invention is to solve or at least reduce the problems discussed above.

A further object of the present invention is to provide an electronic lock device which is capable of operating a mechanical lock case for a building door by first engaging the mechanical lock case, and thereafter locking or unlocking the lock case.

An idea of the present invention is to make use of an engagement member which will pivot in and out from an engaged position, in which the electric motor will drive the lock mechanism of the lock case. The pivot movement is due to initial rotation of the electrical motor. The electronic lock device thus engages the mechanical lock case by a very small movement, thereby having a fast unlocking, and low power consumption. Additionally, the electronic lock device allows for customized operation schemes depending on the choice of associated lock case; by programming the electronic lock device to perform pre-determined back-and-forth movements a very reliable disengagement of the electrical motor is possible.

According to a first aspect, an electronic lock device configured to be externally mounted on a building door is provided. The lock device is configured to operate a lock by moving a lock bolt of an associated lock case between a retracted position and a protruded position, and the lock device comprises an electrical motor and a transmission for connecting said electrical motor to the associated lock case. Said transmission comprises a rotatable shaft configured to be connected to a lock follower of the lock case, and a rotatable member being drivingly connected to the electrical motor and being connected to an engagement member; the engagement member is allowed to pivot upon rotation of the rotatable member, such that the engagement member is engaging with the rotatable shaft when the electrical motor is driving the rotatable member.

The engagement member may be arranged adjacent to the rotatable shaft wherein rotation of the rotatable member will force the engagement member to move to an engaging position by pivoting. In an embodiment the engagement member is pivotally attached to an intermediate disc, and fixed at an angular position of the rotatable member. The lock device will thus provide a very fast engagement, since the engagement is achieved by forcing the engagement member to pivot.

The rotatable shaft, the rotatable member, and the intermediate disc may be arranged concentrically. Hence, these components may be arranged in a very compact manner thus reducing the size of the lock device.

The intermediate disc may be axially displaced relative the rotatable member such that the intermediate disc may rotate relative the rotatable member in a friction-less manner.

The rotatable member and a rotational axis of the electrical motor may form a bevel gear, thus implementing a very robust and reliable connection for transferring rotational movement.

The engagement member may be arranged radially outside the rotatable shaft, and the engagement member may be provided with at least one protrusion extending radially inwards from its inner periphery, and the rotatable shaft may be provided with at least one recess at its outer periphery, such that the rotatable shaft is forced to rotate with the engagement member when the protrusion is engaging the recess. Mechanical connection and engagement between the electrical motor and the rotatable shaft is thus achieved in a very robust manner.

The lock device may further comprise a sensor, such as a rotary encoder, for determining the angular position of the engagement member.

In an embodiment the lock device further comprises communication means associated with controller means, said controller means being configured for controlling the electrical motor based on information received by said communication means from a key device. The controller means may be programmed to control the electrical motor such that the electrical motor, when activated for operating the associated lock, performs a motion in a first direction in order to connect the engagement member with the rotatable shaft and to rotate the shaft, and a subsequent motion in an opposite direction in order to disconnect the engagement member from the rotatable shaft. The lock device will thus always return to a mode in which manual operation is possible without moving the electrical motor.

The motion in the first direction may correspond to a first angular distance, and the motion in the second direction may correspond to a second angular distance, the first angular distance being greater than the second angular distance.

According to a second aspect, a door lock system is provided. The system comprises a lock device according to the first aspect, and one or more key devices.

In an embodiment the controller means is connected to a memory storing lock access data including key device identifiers of said one or more electronic key devices, whereby said key identifiers may be transmitted from the one or more key devices to the lock device by means of short-range wireless data communication, for activating the electrical motor of the lock device.

According to a third aspect a method for operating an electronic lock device in order to move a lock bolt of an associated lock case between a retracted position and a protruded position is provided. The method comprises the steps of controlling an electrical motor by means of controller means based on information received by a communication means from a key device; performing a motion of the electrical motor in a first direction in order to i) connect an engagement member of a transmission of the lock device with a rotatable shaft of the lock device by pivoting, and to ii) rotate the shaft being connected to a lock follower of the lock case, and performing a subsequent motion in an opposite direction in order to disconnect the engagement member from the rotatable shaft.

BRIEF DESCRIPTION OF DRAWINGS

The above, as well as additional objectives, features and advantages of the present invention, will be better understood through the following illustrative and non-limiting detailed description of embodiments of the present invention, reference being made to the appended drawings.

DETAILED DESCRIPTION

Figure 1:
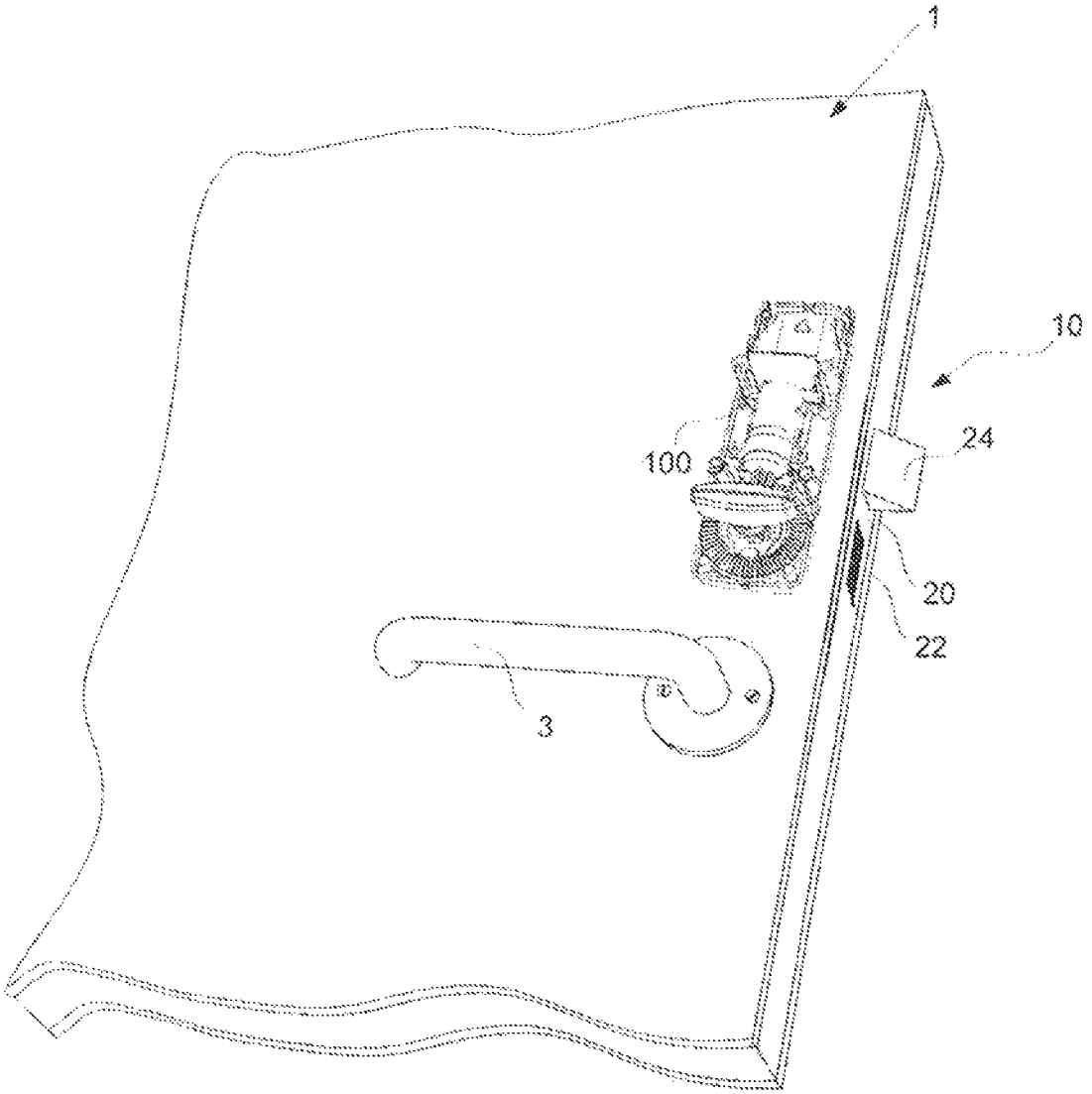
FIG. 1 is an isometric view of a part of a door having an electronic lock device according to an embodiment.

In FIG. 1 a part of a door 1 according to an embodiment is shown. The door 1 represents a standard building door, comprising a door leaf being hinged to a frame (not shown) at one of its lateral edges such that the door 1 may be opened by pivoting the door along a vertical axis. In order to lock the door 1, and hence control who is authorized to enter the area behind the door 1 in use, the door 1 is provided with a door lock 10. The door lock 10 comprises a lock case 20 and an electronic lock device 100 in connection with the lock case 20.

The lock case 20 is a mechanical device for allowing retraction and protrusion of a lock bolt (or deadbolt) 22; a corresponding recess (not shown) is provided in the adjacent frame for accommodating the protruded lock bolt 22 when the door lock 10 is locked. Further, the lock case 20 comprises a latch 24 which is moveable in and out from the lock case for engaging with a corresponding recess in the frame.

According to today's standards the lock case 20 is preferably inserted into a recess of the door leaf, the recess extending from one lateral edge of the door leaf. In order to maneuver the latch 24 of the door lock 10 the lock case 20 may be provided with a latch follower, i.e. a cylindrical shaft which may be connected to a door handle 3. When the door handle 3 is pressed down, the latch follower will rotate thus urging the latch 24 inwards, and out from the recess of the frame thus allowing the door 1 to be opened. In order to maneuver the lock bolt 22 of the door lock 10 the lock case 20 may be provided with a lock follower, i.e. a cylindrical shaft which may be connected to a turning knob or a lock cylinder. When the turning knob or lock cylinder key is rotated, the lock follower will rotate thus moving the lock bolt 24 in or out from the lock case 20.

The lock case 20 may be of any kind as long as it provides movement of a lock bolt 22 in accordance with the description above. For example, the lock case may be constructed such that a rotation of the lock follower is possible until the lock bolt is in any of its two end positions; either a locked position or an unlocked position. The lock case may in other embodiments be constructed such that the lock follower is possible to rotate even passed the end position of the lock bolt; either such that a spring-biased latch is maneuvered if the rotational movement continues with the same torque once the lock bolt has been fully retracted, or such that a spring-biased latch is maneuvered if the rotational movement continues with an increased torque once the lock bolt has been fully retracted.

As can be seen in FIG. 1 the electronic lock device 100 is provided on an inner side of the door leaf 1, such that the electronic lock device is invisible for a person wanting to access the door from the outside. Hence, the outside of the door 1 may be provided with a door handle for operating the latch 24, and a lock cylinder for manually locking the door lock 10 by means of a mechanical key.

In a preferred embodiment the lock device 100 comprises a protective cover which is not shown in FIG. 1.

Figure 2:
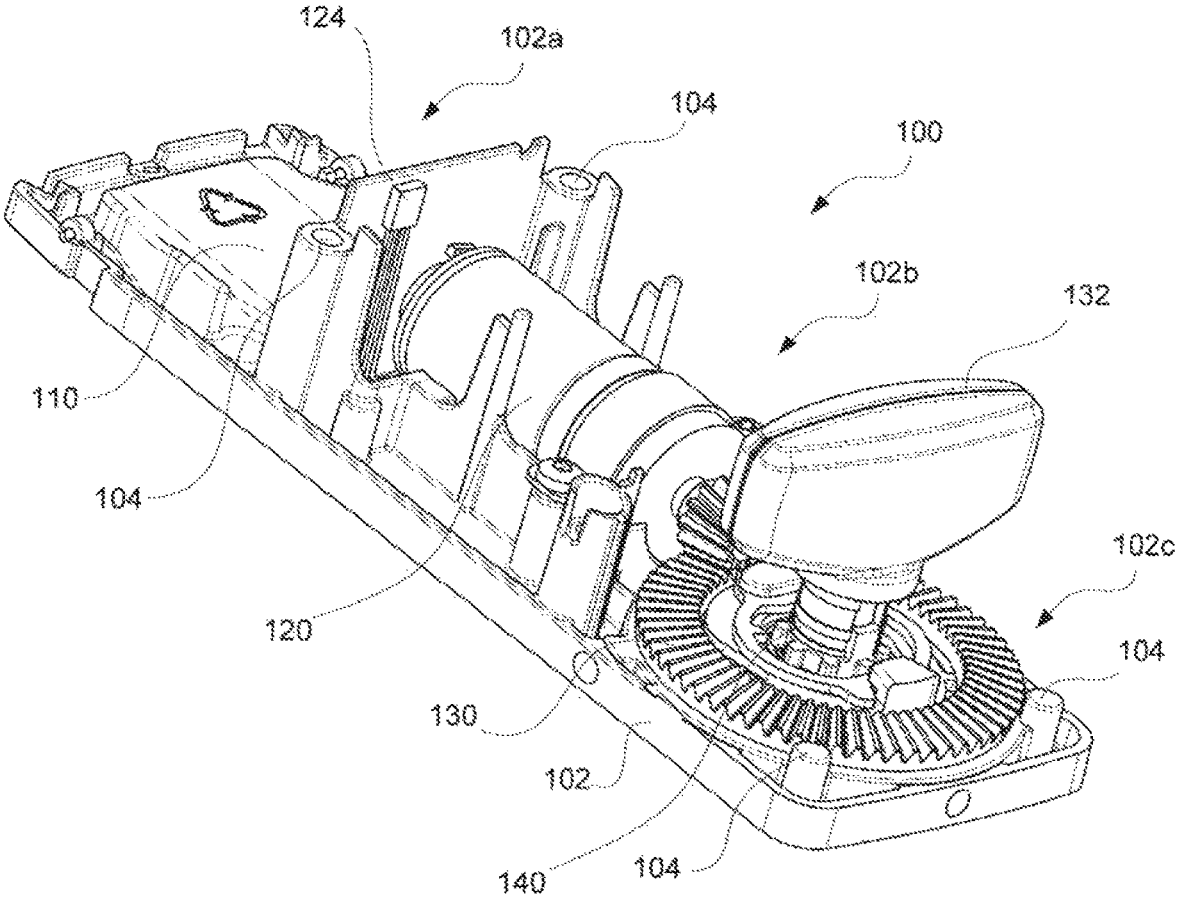
FIG. 2 is an isometric view of the electronic lock device shown in FIG. 1.

The details of the electronic lock device 100 are further shown in FIG. 2. A base plate 102 forms a support for the remaining components of the lock device 100, and preferably comprises means 104 for attaching the base plate 102 to the planar surface of the door leaf 1. For the embodiment shown in FIG. 2 the means are formed as a plurality of sleeves for guiding screws (not shown).

The base plate 102 comprises three sections 102*a*, 102*b*, 102*c*, of which the first section 102*a* accommodates electrical circuits and power electronics 110, the second sections 102*b* accommodates an electrical motor 120 and a sensor 124, while the third section 102*c* accommodates a transmission 130 for transferring a rotational movement of the electrical motor 120 to the lock follower of the lock case 20.

The electronic lock device 100 is configured to operate the door lock 10 by moving the lock bolt 22 of the associated lock case 20 between a retracted position and a protruded position. For this, the lock device 100 is mounted such that the transmission 130 is aligned coaxially with the lock follower of the lock case 20. A turning knob 132 is connected to a rotatable shaft 140, which rotatable shaft 140 is configured to be connected with the lock follower of the lock case 20. Hence, when the turning knob 132 is rotated, the lock follower will rotate accordingly thus operating the lock bolt 22 of the lock case 20.

Figure 3A:
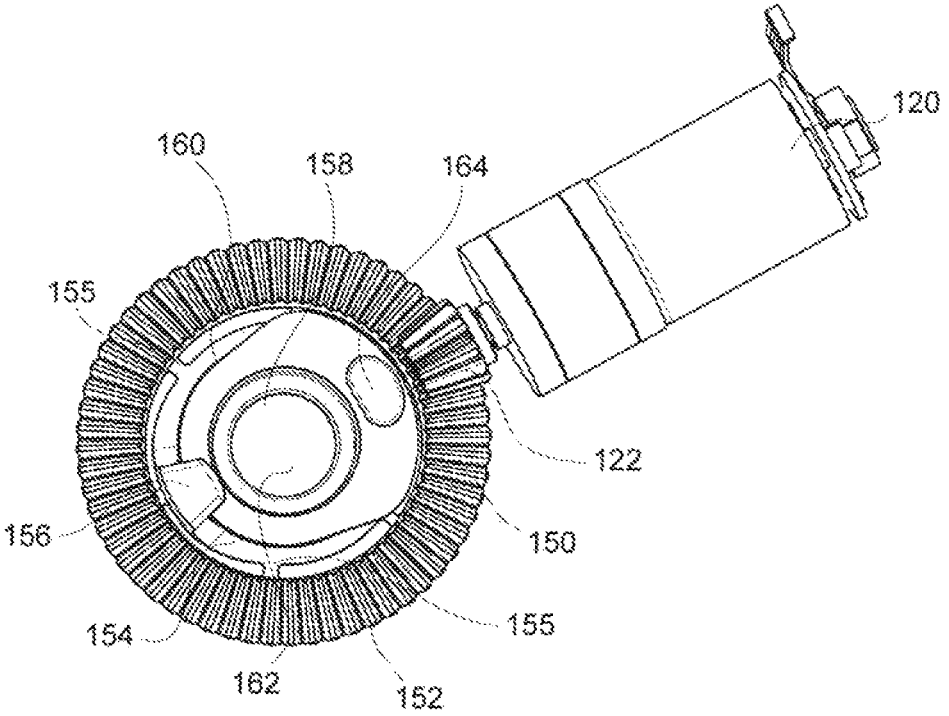
FIGS. 3*a-e* shows parts of an electronic lock device according to an embodiment.

The electric motor 120 and the transmission 130 are further shown in FIGS. 3*a-e*. In FIG. 3*a* the electrical motor 120 is shown as well as a rotatable member 150 in the form of a gear. The rotational axis of the electrical motor 120 is provided with a further gear 122, wherein the two gears 122, 150 together form a bevel gear.

The rotatable member 150 is thus drivingly connected to the electrical motor 120. The rotatable member 150 has a circular shape, of which the outer part is provided with teeth 152 forming the gear. The teeth 152 are arranged along the entire periphery of the rotatable member 150. The gear portion, i.e. the outer part having the teeth 152, is connected to a central portion 154 by means of one or more yielding bridges 155. The yielding bridges 155 form radial ribs which ensures that the central portion 154 rotates with the gear portion. However, the yielding bridges 155 also form a measure for allowing the electrical motor 120 to be completely disconnected from the central portion 154 as will be further described below.

The central portion 154 comprises a lug 156 which protrudes axially away from the otherwise planar surface of the central portion 154. The lug 156 may have a slightly convex shape seen in the direction radially inwards. Further to this, a through hole 158 is provided centrally of the central portion 154 for allowing the rotatable shaft 140 to be inserted therein.

An intermediate disc 160 is arranged onto the rotatable member 150 in a coaxial manner. Preferably, the intermediate disc 160 is axially spaced apart from the rotatable member 150 such that the intermediate disc 160 is allowed to rotate relative the rotatable member 150 in a friction-less manner. For this, the intermediate disc 160 may be axially secured to the housing, or base plate 102, by means of a disc spring such that the rotational friction of the intermediate disc 160 is controlled.

The intermediate disc 160 has a centrally arranged through hole 162 for receiving the rotatable shaft 140 in the same manner as the rotatable member 150. Further to this, the intermediate disc 160 is provided with a pivot joint 164. The pivot joint 164 is used for connecting the intermediate disc 160 with an engagement member 170, such that the engagement member 170 may pivot relative the intermediate disc 160. The pivot joint 164 is preferably arranged at the outer periphery of the intermediate disc 160.

Figure 3B:
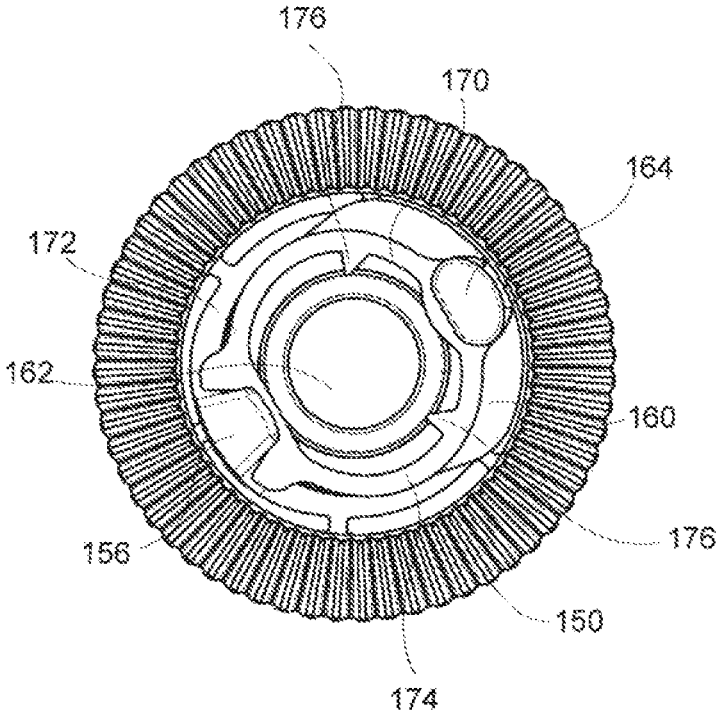
Figure 3C:
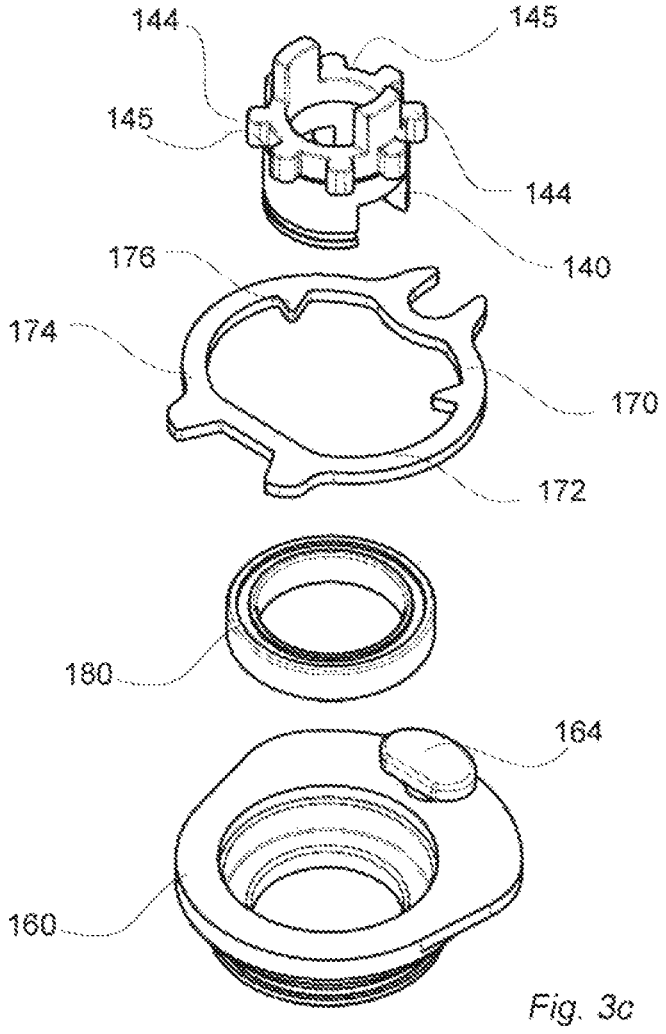

The engagement member 170, further shown in FIGS. 3*b* and 3*c*, has an annular shape although not necessarily being circular. From the pivot joint 164 a first leg 172 of the engagement member 170 extends radially outwards the through hole 162 in a first angular direction, while a second leg 174 of the engagement member 170 extends radially outwards the through hole 162 in the opposite angular direction. The first leg 172 and the second leg 174 meet approximately 180° from the pivot joint 164. At this point, where the first leg 172 and the second leg 174 meet, they are connected to the rotatable member 150 via the lug 156. The slightly convex shape of the lug 156 ensures that the engagement member 170 is prevented from moving away from the desired position relative the rotatable member 150.

The first leg 172 and/or the second leg 174 is preferably provided with one or more protrusions 176 extending radially inwards, i.e. towards the through hole 162 of the intermediate disc 160. The minimum inner diameter of the engagement member 170 is slightly larger than the maximum outer diameter of the rotatable shaft 140.

Figure 3D:
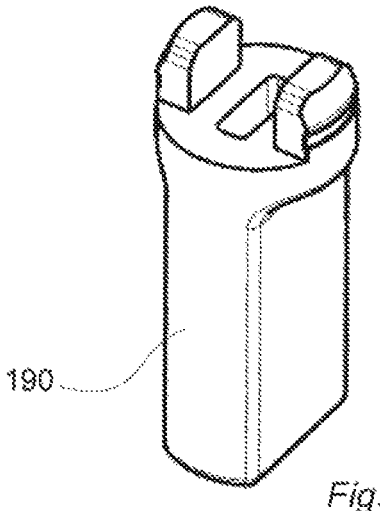
Figure 3E:
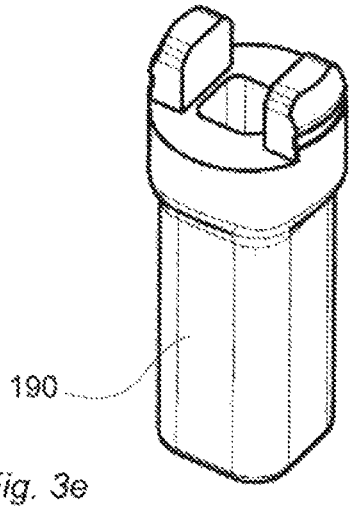

The rotatable shaft 140 is insertable into the through holes of the rotatable member 150 and the intermediate disc 160, such that the rotatable shaft 140, the rotatable member 150, and the intermediate disc 160 are arranged coaxial. Preferably, a bearing 180, such as a roller bearing, is provided between the rotatable shaft 140 and the disc 160. The rotatable shaft 140 has a cylindrical shape, the inner diameter being configured to receive a support rod for a turning knob, as well as a guiding rod 190 for the lock follower of the associated lock case 20. Different embodiments of the guiding rod 190 are shown in FIGS. 3*d* and 3*e*, wherein the guiding rod 190 of FIG. 3*d* is configured to fit with a rectangular lock follower, while the guiding rod 190 of FIG. 3*e* is configured to fit with a square shaped lock follower. The guiding rod 190 also fits with the rotatable shaft 140, and it comprises a recess for receiving the support rod for the turning knob. Hence, rotating the turning knob will effect corresponding rotation of the rotatable shaft 140 via the guiding rod 190. The outer periphery of the rotatable shaft 140 is provided with a plurality of teeth 144. A recess 145 is formed between two adjacent teeth 144 whereby the recess 145 is configured to accommodate a protrusion 176 of the engagement member 170.

In the following, operation of the lock device 100 will be described. When the door 1 is locked, the lock device 100 is arranged in an idle mode corresponding to a mode in which the electrical motor 120 is in no driving connection with the lock follower of the lock case 20. Hence, a person operating the door lock by e.g. turning the turning knob of the lock device 100 will not need to also turn the rotor of the electrical motor. This idle mode is achieved by arranging the pivot joint 164 of the intermediate disc 160 approximately 180° away from the lug 156 of the rotatable member 150, whereby the engagement member 170 is coaxial with the rotatable shaft 140. Should electrical operation be initiated the electrical motor will start to run, thus driving the rotatable member 150. Upon this the movement of the lug 156 will force the engagement member 170 to pivot relative the rotatable shaft 140 such that the protrusion(s) 176 will engage with a recess 145 of the rotatable shaft 140. While continuing the rotational movement of the rotatable member 150 the rotatable shaft 140 will also rotate since the engagement of the recess 145 will drive the rotatable shaft 145. When the operation is finished, i.e. the door 1 is either locked or unlocked, the electrical motor 120 is controlled to perform a small rotation in the opposite direction whereby the engagement member 170 will pivot back to its idle position. The last small rotation, for returning the transmission back to its idle position, is preferably monitored and controlled by means of the sensor 124, allowing for accurate control such that the engagement member 170 is pivoting the desired amount.

The above described operation scheme is particularly advantageous for a lock case of which the lock follower, to which the rotatable shaft 140 is connected, is unelastically connected to the lock bolt. Hence, the end position is fixed as there is no flexibility allowing further movement of the lock follower pass the end position.

Should another lock case be used, e.g. a lock case having a spring-biased lock bolt and latch, the electrical motor is programmed according to the following. For unlocking the door, the electrical motor is activated for engaging the engagement member 170 with the rotatable shaft 140, and to continue the rotational movement until the end position is reached. As there is a spring force urging the lock bolt back to its locked position, the electrical motor performs a rotational movement in the opposite direction, i.e. for locking the door, until the locked end position is reached. From here, the electrical motor again changes rotational direction, and performs a small rotation in the opposite direction whereby the engagement member 170 will pivot back to its idle position.

A yet further operational scheme is used for a lock case, for which once the lock bolt is in its end position unlocking the door, the lock follower may be further rotated in the unlocking direction for causing a subsequent opening movement of a spring-biased latch. For this application the electrical motor is programmed to unlock the door by an initial unlocking movement similar to what has been described above. However, when the lock follower has reached its end position the rotational direction of the electrical motor is changed for driving the lock follower in the locking direction such that any forced action, provided by the spring, is compensated. From this idle, unlocked position the rotational direction is again changed, whereby a subsequent movement of the electrical motor ensures an idle, and disengaged, position of the engagement member 170.

The presented transmission 130 is advantageous in that it allows for manual operation even if the electrical motor 120 should be damaged at a time where the engagement member 170 engages with the rotatable shaft 140. If it is no longer possible to rotate the rotor of the electrical motor 120, the lock device 100 may still be used manually since a high torque input to the rotatable shaft 140 may cause the yielding bridges 155 to brake and thus permanently disconnect the electrical motor from the rotatable shaft 140. Further to this, the teeth 176 are preferably configured to have a non-symmetrical shape such that an apex connects to the associated leg 172, 174 via two sides, wherein the angle of one side will be in parallel with a side surface of an adjacent teeth 144 of the rotatable shaft 140, while the other side will be tilted relative the side surface of an adjacent teeth 144 of the rotatable shaft. Hence, even if the engagement member 170 is engaged with the rotatable shaft 140 despite commanded disengagement, manual operation of the rotatable shaft 140 will always be possible in one direction for disengaging the engagement member 170 from the rotatable shaft 140 since the teeth 144 will be allowed to slide relative the tilted surface of the teeth 176.

In a preferred embodiment the lock device 100 is provided with a motion sensor 124, such as a pulse sensor or rotary encoder connected to the rotational shaft of the electrical motor 120. By means of suitable electronics it will thus be possible to determine the exact angular position upon disengagement, i.e. when the electrical motor 120 is controlled to perform a small rotation in the opposite direction whereby the engagement member 170 will pivot back to its idle position. Since a too long movement will cause engagement, the provision of a motion sensor, or position sensor, will improve the accuracy of the lock device.

In an even more preferred embodiment, the lock device 100 is also provide with a motion sensor, or position sensor, arranged at the rotatable shaft 140. By means of suitable electronics it will thus be possible to determine the exact angular position of the rotatable shaft 140 whereby it is possible to determine if the lock is in a locked state, or an unlocked state.

As the lock device 100 is electronically controlled, a simple and secure control scheme may be an important issue for providing a successful implementation of the lock device in e.g. elderly care applications. However, the presented lock device 100 may also be implemented in other applications, such as hotels, storage facilities, rental apartments, etc.

Figure 4:
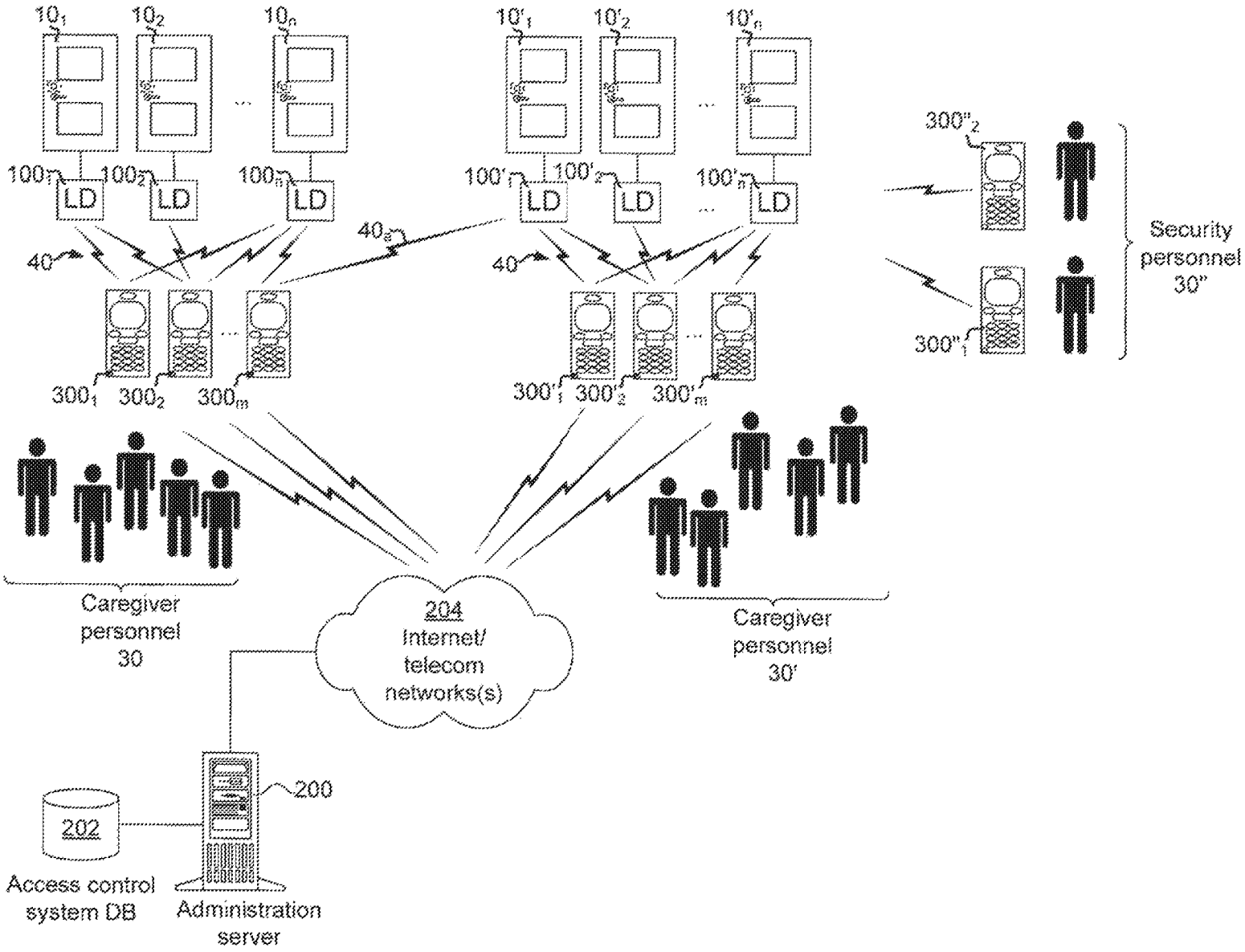
FIG. 4 is a schematic view of an access control system in which embodiments of the present invention may be exercised.

FIG. 4 illustrates, in a schematic and simplified form, the layout of an access control system for elderly care. A first team of caregiver personnel 30 is responsible for the elderly care of a first group of caretakers, all living in rooms or apartments covered by respective front doors 101-10*n*. Lock devices 1001-100*n* are installed on the respective front doors 101-10*n* and serve as gateways to the respective protected environment (i.e. room or apartment) behind each door. A first pool of key devices 3001-300*m* is available to the first team of caregiver personnel 30. The key devices 3001-300*m* may be mobile terminals. Each lock device 1001-100*n* contains lock access data which includes the key device identifiers of the key devices 3001-300*m* which are allowed to access the lock device in question.

When a user in the first team starts his shift, he will check out one of the key devices 3001-300*m* from a caregiver central, for instance key device 3001. During his shift, he will use key device 3001 to gain access to various ones of the front doors 101-10*n* to provide the care required by the respective caretakers. This access will be provided by way of Bluetooth® communication between key device and lock device, as indicated at 40 in FIG. 4. Therefore, the key device identifiers mentioned above may advantageously be represented by the unique Bluetooth® addresses assigned to the Bluetooth® transceivers in the respective key devices.

At the end of his shift, the user will again check in and return the key device 3001 to the caregiver central. In addition or alternatively, some or all members of the first team of caregiver personnel 30 may use their own mobile terminals as key devices. Not all key devices or members of the first team of caregiver personnel 30 may be authorized to access all doors, and they need not all have the same level of authorization in terms of times and/or dates when access is allowed.

The access control system of FIG. 4 further involves a second team of caregiver personnel 30' responsible for serving a second group of caretakers, the rooms or apartments of which have respective front doors 10'1-10'*n* to which lock devices 100'1-100'*n* are installed. A second pool of key devices 300'1-300'*m* is available to the second team of caregiver personnel 30'. Of course, the access control system may in reality include additional teams of caregiver personnel, additional groups of caretakers, additional front doors, additional lock devices, and additional pools of key devices.

In addition, security personnel 30" with key devices 300"1-300"2 are included in the system. Whereas the key devices 3001-300*m*, 300'1-300'*m* of the first and second teams 30, 30' will be used by a relatively large number of caregiver persons to access a relatively small number of lock devices/doors at relatively frequent occasions, the situation is the opposite for the key devices 300"1-300"2 of the security personnel 30". These key devices will be used by a limited number of persons (such as nurses or guards) at rare occasions, but they nevertheless need to be able to access a very large number of lock devices/doors—or even all lock devices/doors that are included in the access control system.

For enhanced security, each key device runs an access control software application in which the user must log on. Also, all communications with the lock devices are encrypted. Further, not all users/key devices are allowed to bring updated lock access data to the lock devices. Rather, in the embodiment of FIG. 4, a subset of particularly trusted users/key devices are designated as ambassadors; only these will be allowed to bring updated lock access data to the lock devices.

Each team of caregiver personnel 30, 30' may be subdivided into sub-groups, for instance a day shift, an evening shift and a night shift. Also, an individual user may act in or for both teams 30 and 30' (for instance to serve as back-up in situations of sickness, parental leave or during popular holiday periods), therefore having a need to use his key device for accessing lock devices both in the first group of caretakers and in the second group of caretakers. This is illustrated in FIG. 4 for key device 300*m*, which will access not only lock device 100*m* in the first group of caretakers, but also lock device 100'1 in the second group of caretakers (see arrow 40*a*).

Figure 5:
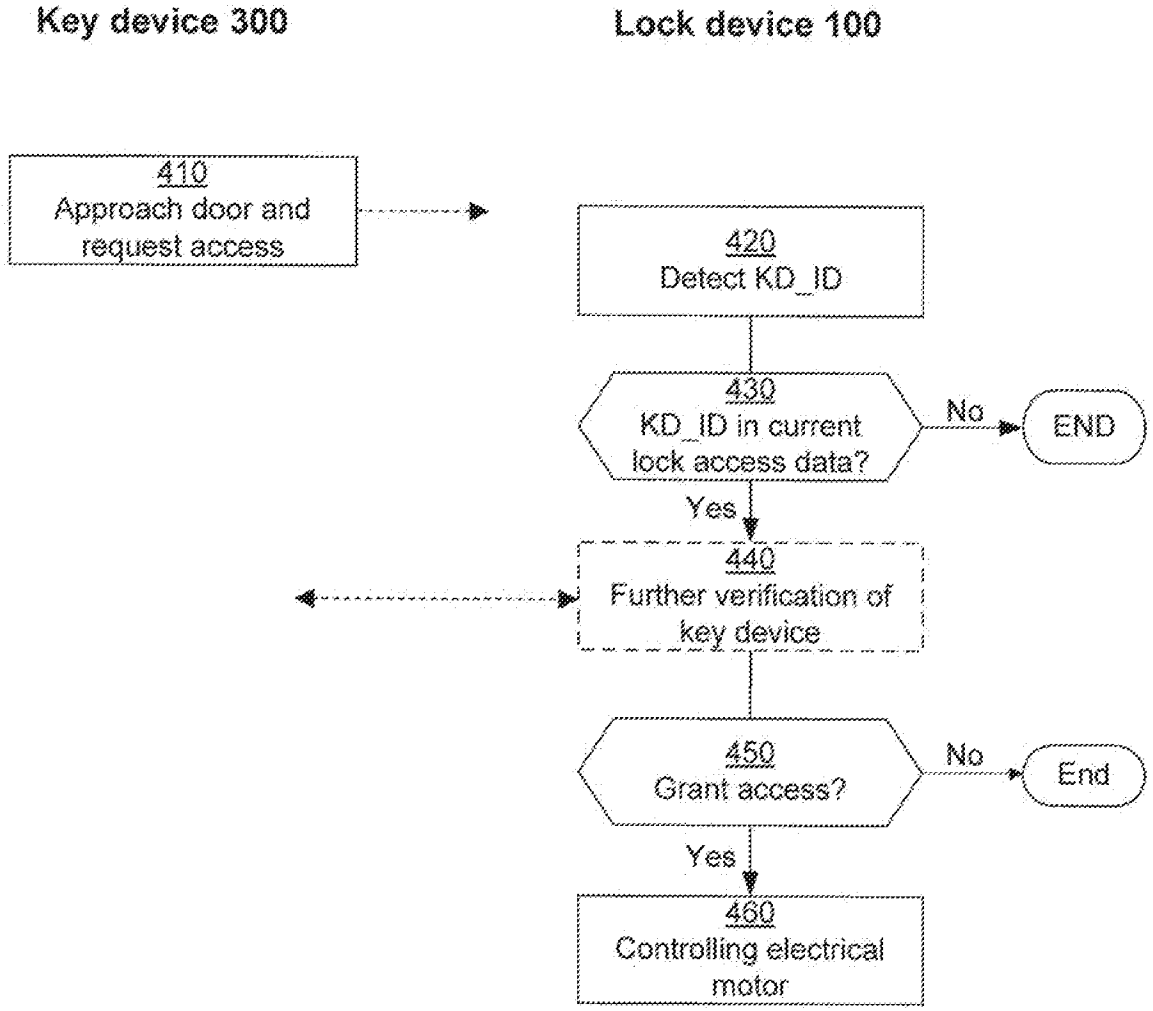
FIG. 5 illustrates an access control method which may be performed in the access control system of FIG. 4.
Figure 6:
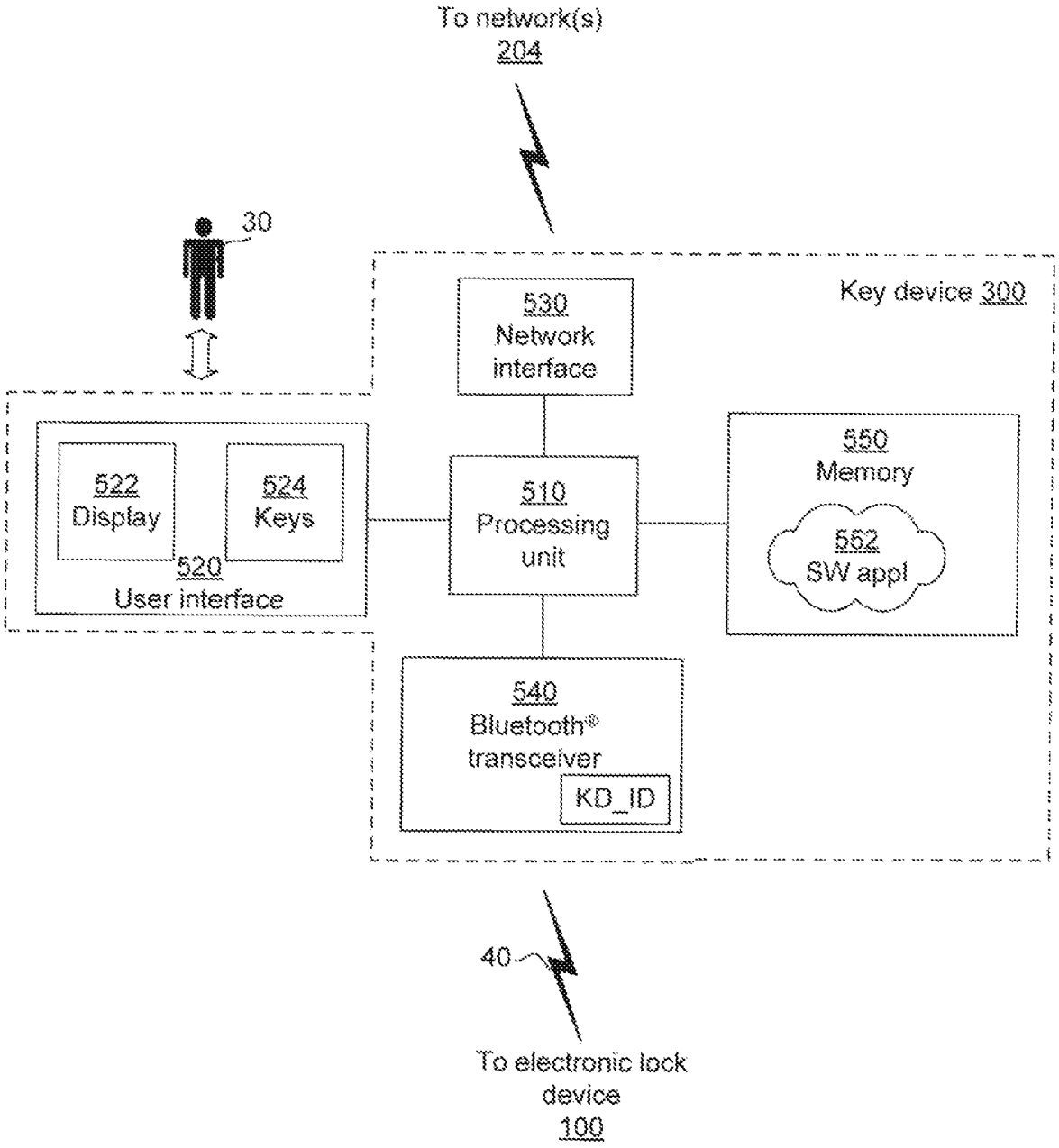
FIG. 6 is a schematic block diagram of a key device which may interact with a lock device in the access control system of FIG. 4.
Figure 7:
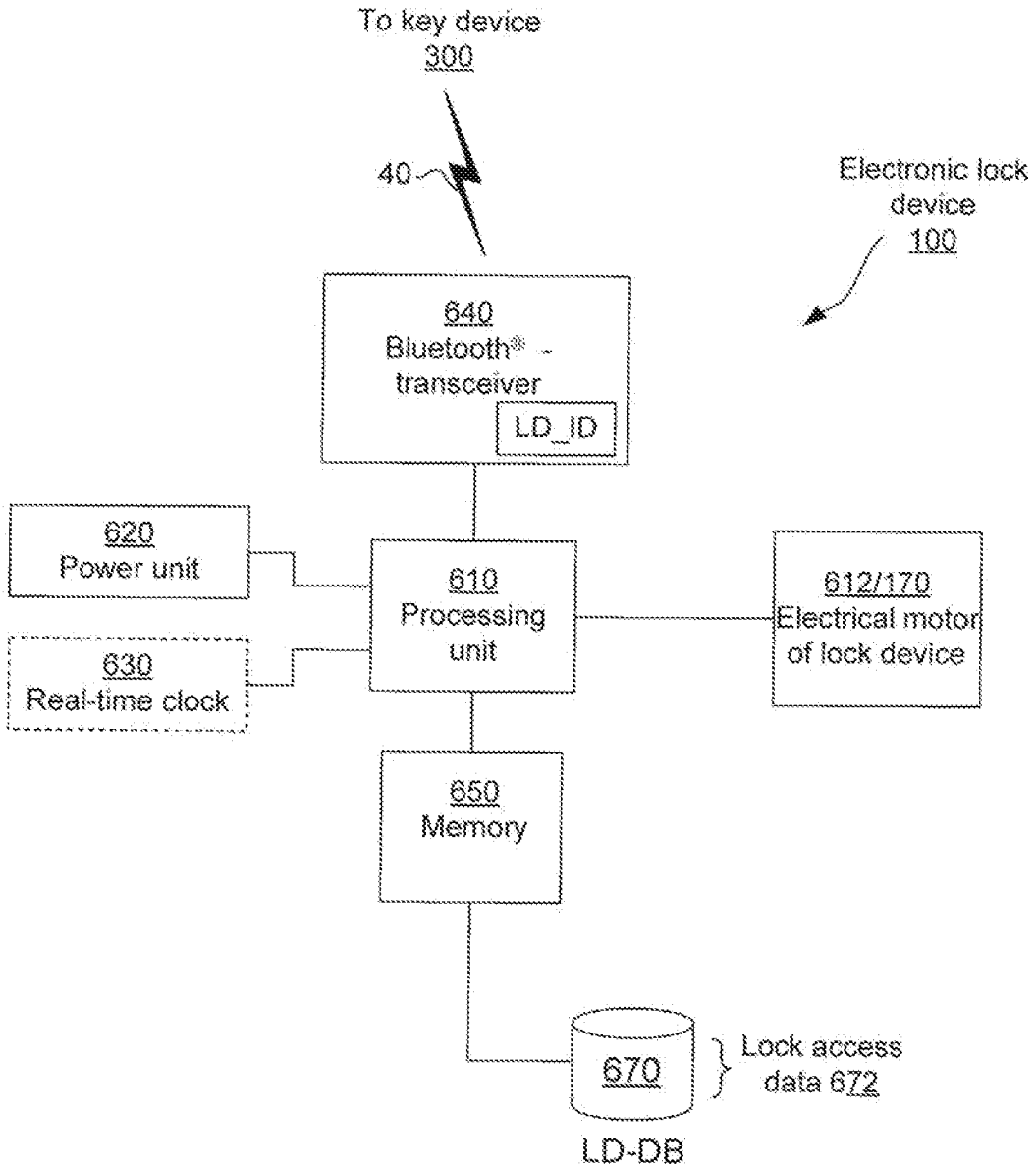
FIG. 7 is a schematic block diagram of a lock device according to one embodiment.

FIG. 5 illustrates how access can be granted for the embodiment shown in FIG. 4. In FIG. 5, it is assumed that one of the key devices 3001-300*m*, 300'1-300'*m* approaches one of the lock devices 1001-100*n*, 100'1-100'*n* in step 410. This individual key device is referred to as key device, or KD, 200 in the following, and the main components of the key device 300 are shown in FIG. 6. The corresponding individual lock device is referred to as lock device, or LD, 100, and its main components are shown in FIG. 7. The individual caregiver person that uses the key device 300 is referred to as user 30.

In the embodiment disclosed in FIG. 6, the key device 300 is a mobile terminal, e.g. a cellular telephone, personal digital assistant (PDA), smart phone, etc., which is capable of communicating with a telecommunications system. Thus, the user 30 may use the key device 300 for various telecommunication services, such as voice calls, Internet browsing, video calls, data calls, facsimile transmissions, still image transmissions, video trans-missions, electronic messaging, and e-commerce. Generally, these telecommunication services are not central within the context of the present invention; there are no limitations to any particular set of services in this respect. Therefore, only components which are somehow pertinent to the inventive functionality are shown in FIG. 6.

As seen in FIG. 6, the key device 300 has a network interface 530 for connecting to the Internet/telecommunications network(s) 204. The network interface 530 may comply with any commercially available mobile telecommunications standard, including but not limited to GSM, UMTS, LTE, D-AMPS, CDMA2000, FOMA and TD-SCDMA. Alternatively or additionally, the network interface 530 may comply with a wireless data communication standard such as WLAN (Wireless Local Area Network). The key device 300 also has a man-to-machine interface (MMI), or user interface (UI) 520, which may include a display 522 and a set of keys 524 or other input device, as well as other known UI elements like a speaker and a microphone. The user 30 may control the operation of, and exchange data with, the key device 300 over the user interface 520.

Further, the key device 300 has an interface 540 for short-range wireless data communication. In the disclosed embodiment of FIG. 6, the interface 540 comprises a Bluetooth® transceiver, by means which the key device 300 can communicate with, for instance, the lock device 100 over the Bluetooth® link 40. The Bluetooth® transceiver is assigned a unique Bluetooth® address KD_ID. Alternatively or additionally, the interface 540 may for instance comprise transceiver components for IrDA (Infrared Data Association), WLAN/WiFi or NFC (Near Field Communication).

A processing unit 510 is overall responsible for the operation and control of the different components of the key device 300. The processing unit 510 may be implemented in any known controller technology, including but not limited to a processor (PLC, CPU, DSP), FPGA, ASIC or any other suitable digital and/or analogue circuitry capable of performing the intended functionality.

Finally, the key device 300 has a memory 550 which is operatively connected to the processing unit 510. The memory 550 may be implemented by any known memory technology, including but not limited to E(E)PROM, S(D)RAM and flash memory, and it may also include secondary storage such as a magnetic or optical disc. Physically, the memory 550 may consist of one unit or a plurality of units which together constitute the memory 550 on a logical level. In addition to storing various program instructions and data for the various functions and applications which are typically available in a mobile terminal, the memory 550 also comprises the program instructions 552 and work data for the aforementioned access control software application.

With reference to FIG. 7, in addition to the mechanical components already described with reference to FIGS. 3 and 4*a-c*, the lock device 100 according to the disclosed embodiment generally comprises the following main components. A controller means or processing unit 610 is overall responsible for the operation and control of the different components of the lock device 100. The controller means or processing unit 610 may be implemented in any known controller technology, including but not limited to a processor (PLC, CPU, DSP), FPGA, ASIC, or any other suitable digital and/or analogue circuitry capable of performing the intended functionality.

The lock device 100 of this embodiment is a stand-alone, autonomously operating device which requires no wire-based installations, neither for communication nor for power supply. Instead, the lock device 100 is powered solely by a local power unit 620 which comprises one ore more long-life batteries. It interacts with key devices, as already mentioned, by wireless activities. The lock device 100 therefore has communication means 640 which in the disclosed embodiment takes the form of an interface 640 for short-range wireless data communication. More specifically, in the disclosed embodiment of FIG. 7, the interface 640 comprises a Bluetooth® transceiver, by means of which the lock device 100 can communicate with, for instance, the key device 300 over the Bluetooth® link 40. The Bluetooth® transceiver is assigned a unique Bluetooth® address LD_ID. Alternatively or additionally, the interface 640 may for instance comprise transceiver components for IrDA, WLAN or NFC.

The lock device 100 of the disclosed embodiment further includes a real-time clock 630 capable of providing the processing unit 610 with an accurate value of the current time. However, embodiments are also possible where no real-time clock is provided.

Finally, the lock device 100 has a memory 650 which is operatively connected to the processing unit 610. The memory 650 may be implemented by any known memory technology, including but not limited to E(E)PROM, S(D)RAM and flash memory, and it may also include secondary storage such as a magnetic or optical disc. Physically, the memory 650 may consist of one unit or a plurality of units which together constitute the memory 650 on a logical level. The memory 650 serves to store various program instructions and work data for functions to be performed by the processing unit 610 in order to carry out the tasks of the lock device 100. Moreover, the memory 650 serves to store a local lock device database (LD-DB) 670, which includes lock access data 672 upon which the access control decisions are based (as described below for FIG. 5).

Referring back to step 410 in FIG. 5, when the user 30 has brought his key device 300 near the door 10 which is provided with the lock device 100, the user may request access by issuing a command in the user interface of the key device 300, e.g. by invoking a function in the aforementioned access control software application. In alternative embodiments, this may instead occur automatically. For instance, if the lock device 100 has access to the output signal of a presence sensor on or at the door 10, the lock device 100 may detect the presence of the user 30 and in response trigger performance of the remaining steps. As further alternatives, the key device 300 or the lock device 100 may be configured to regularly transmit beacon signals (e.g. Bluetooth® inquiries) which may be detected and responded to by the other device.

In a following step 420, the lock device 100 will detect the key device identifier KD_ID by reading, from the Bluetooth® communication traffic between the devices, the Bluetooth® address assigned to the Bluetooth® transceiver 540 in the key device 300. It is to be noticed that it is not necessary to wait until a bidirectional Bluetooth® link has been established in order to detect the Bluetooth® address of the key device 300, since the Bluetooth® address is included in and can be read already from the initial Bluetooth® messages which are sent between the devices e.g. during paging, handshaking and initiation.

Then, in a step 430, the lock device 100 will check if the detected key device identifier KD_ID matches the lock access data 672 currently stored in its internal memory 650. If so, the lock device 100 considers the key device 300 as a known key device and proceeds to an optional step 440, in which further verification of the key device 300 may take place. Such further verification may include establishing and further communicating over a bidirectional Bluetooth® link 40 between the lock device 100 and key device 300. For instance, the access control software application in the key device 300 may prompt the user to enter a PIN code on a keypad of the key device 300, and the PIN code may be communicated over the Bluetooth® link to the lock device 100, which may compare the received PIN code with a prestored PIN code associated with the key device identifier KD_ID in the lock access data 672. Alternatively or additionally, the user 30 may provide some biometric data, such as a scanned fingerprint, by means of the key device 300, to be evaluated by the lock device 100 upon receipt.

In a subsequent step 450, the lock device 100 determines whether or not the key device 300/user 30 shall be granted access or not. This may involve checking that the KD_ID of the key device 300 was recognized in step 430 as a known KD_ID which is not included in a "black list" of blocked key device identifiers in the lock access data 672. If the optional step 440 is applied, the determination in step 450 will also include a check that the further verification in step 440 was successful.

A favorable decision in step 450 will trigger a step 460 in which the actual access is made to happen. This may involve actuating the electric motor 180 to engage the coupling mechanism 120, so that it will no longer disengage the input member 130 from the output shaft 150. This is collectively referred to as lock device actuator 612 in FIG. 8.

An unfavorable decision in step 450 will instead result in termination of the procedure of FIG. 5, without any performance of step 460.

It is expressly to be noticed that the mechanical components of the lock device 100, an exemplifying embodiment of which have been described above with reference to FIGS. 3 and 4*a-c*, may be used with other access control means than the elements 610-670 described above for FIG. 7. Basically, any wired or contactless arrangement for detecting and verifying an approaching user 30 may be employed for controlling the actuator 170. Non-limiting examples of such arrangements include keypads, biometrical readers or scanners, magnetic card readers, smartcard readers, inductive tag detectors, barcode readers, etc., or any combination thereof. Hence, the lock device 100 may be actuated by other key devices than mobile phones and similar portable communication devices, including but not limited to a human finger, eye or face; a magnetic card, a smartcard, an inductive tag, a barcode, etc., or any combination thereof.

Further, it is apparent to a person skilled in the art that with the advancement of technology, the basic idea may be implemented in various ways. The invention and its embodiments are thus not limited to the examples described above; instead they may vary within the scope of the claims.

The invention claimed is:

1. An electronic lock device configured to be externally mounted on a building door and being configured to operate a lock by moving a lock bolt of an associated lock case between a retracted position and a protruded position, said device comprising an electrical motor and a transmission for connecting said electrical motor to the associated lock case, wherein said transmission comprises a rotatable shaft configured to be connected to a lock follower of the lock case, an engagement member arranged adjacent to the rotatable shaft, and a rotatable member being drivingly connected to the electrical motor and being connected to the engagement member, the engagement member is allowed to pivot upon rotation of the rotatable member, such that rotation of the rotatable member will force the engagement member to pivot relative to the rotatable shaft from a disengaged position to an engaging position where the engagement member engages with the rotatable shaft.

2. The lock device according to claim 1, wherein the rotatable member and a gear on an end of a drive shaft of the electrical motor forms a bevel gear.

3. The lock device according to claim 1, wherein the engagement member is arranged radially outside the rotatable shaft, and wherein the engagement member is provided with at least one protrusion extending radially inwards from its inner periphery, and wherein the rotatable shaft has at least one recess formed in its outer periphery, such that the rotatable shaft is forced to rotate with the engagement member when the at least one protrusion is engaging the recess.

4. The lock device according to claim 1, further comprising a sensor for determining an angular position of the engagement member.

5. The lock device according to claim 4, wherein the sensor is a rotary encoder.

6. The lock device according to claim 1, further comprising communication means associated with controller means, said controller means being configured for controlling the electrical motor based on information received by said communication means from a key device.

7. The lock device according to claim 6, wherein the controller means is programmed to control the electrical motor such that the electrical motor, when activated for operating the associated lock, performs a motion in a first direction in order to connect the engagement member with the rotatable shaft and to rotate the shaft, and a subsequent motion in an opposite direction in order to disconnect the engagement member from the rotatable shaft.

8. The lock device according to claim 7, wherein the motion in the first direction corresponds to a first angular distance, and the motion in a second direction corresponds to a second angular distance, the first angular distance being greater than the second angular distance in order to make an secure disengagement independent if the lock case has a spring loaded stop-position.

9. A door lock system, comprising a lock device according to claim 6, and one or more key devices.

10. The door lock system according to claim 9, wherein the controller means is connected to a memory storing lock access data including key device identifiers of said one or more key devices, whereby said key identifiers may be transmitted from the one or more key devices to the lock device by means of short-range wireless data communication, for activating the electrical motor of the lock device.

11. The electronic lock device according to claim 1, further comprising an intermediate disc provided with a pivot joint connecting the intermediate disc with the engagement member, such that the engagement member may pivot relative the intermediate disc.

12. The lock device according to claim 11, wherein the engagement member is pivotally attached to an intermediate disc via the pivot joint, and fixed at an angular position of the rotatable member.

13. The lock device according to claim 12, wherein the rotatable shaft, the rotatable member, and the intermediate disc are arranged concentrically.

14. The lock device according to claim 12, wherein the intermediate disc is axially displaced relative the rotatable member.

15. The lock device of claim 11, wherein the rotatable member is directly connected to the engagement member via the pivot joint.

16. The electronic lock device according to claim 11, wherein the pivot joint is arranged at an outer periphery of the intermediate disc.

17. A method for operating an electronic lock device in order to move a lock bolt of an associated lock case between a retracted position and a protruded position, comprising the steps of:

controlling an electrical motor by means of controller means based on information received by a communication means from a key device;

performing a motion of the electrical motor in a first direction in order to i) connect an engagement member of a transmission of the lock device with a rotatable shaft of the lock device by pivoting due to provision of a pivot joint received in an opening located on a periphery of the engagement member with a rotatable member being driven by the electrical motor, and to ii) rotate the shaft being connected to a lock follower of the lock case, and performing a subsequent motion in an opposite direction in order to disconnect the engagement member from the rotatable shaft.

* * * * *